US007699017B1

(12) United States Patent
Marshall

(10) Patent No.: US 7,699,017 B1
(45) Date of Patent: Apr. 20, 2010

(54) PERSONAL UNDERSEA OBSERVATION PEDAL CRAFT

(76) Inventor: Donald K. Marshall, 5008 Jay Ave., Las Vegas, NV (US) 89130

( * ) Notice: Subject to any disclaimer, the term of this patent is extended or adjusted under 35 U.S.C. 154(b) by 144 days.

(21) Appl. No.: 12/152,202

(22) Filed: May 12, 2008

(51) Int. Cl.
*B63C 11/46* (2006.01)

(52) U.S. Cl. ..... 114/315; 440/26; 440/31

(58) Field of Classification Search ..... 114/315; 440/21, 26, 31
See application file for complete search history.

(56) References Cited

U.S. PATENT DOCUMENTS 3,570,436 A * 3/1971 Le Vasseur ..... 114/315
5,073,134 A * 12/1991 Muller et al. ..... 440/50
5,643,020 A * 7/1997 Harris ..... 440/31
6,033,276 A * 3/2000 Han ..... 441/135
6,524,145 B1 * 2/2003 Arzate ..... 440/15
6,533,621 B1 * 3/2003 Yang et al. ..... 440/31
2005/0223962 A1 * 10/2005 Sueshige et al. ..... 114/315

* cited by examiner

*Primary Examiner*—Stephen Avila

(57) ABSTRACT

A personal water craft propelled on the water's surface by the user pedaling a pedal crank that in turn rotates a propeller thrusting the craft in a forward or rearward direction. Steering is accomplished by an operator-controlled rudder at the aft of the craft. The craft is of unique design lending to persons who desire to snorkel observing undersea life in a comfortable prone position of appropriate pedal posture while enjoying the ease of navigating by pedal propulsion with less expenditure of effort than swimming.

24 Claims, 7 Drawing Sheets

PERSONAL UNDERSEA OBSERVATION PEDAL CRAFT

FIELD OF THE INVENTION

The present invention being a personal water craft mechanically-thrusted on and within bodies of water by the user pedaling a rotably mounted pedal crank that turns an operatively connected propeller creating thrust moving said craft in a navigable manner within an aquatic environment offering a user to observe undersea life while peddling said watercraft in a comfortable position of correct pedal posture.

DESCRIPTION OF PRIOR ART

Several watercraft of pedal propulsion have been claimed threw through the years that propel users while in a prone position of pedal posture.

U.S. Pat. No. 5,368,507 (Harris) discloses a paddle board accepting the user in a prone position lying on said board with the vector of the user's spine being on the same plain as the pedal crank axis. Thrust is provided by a complicated plurality of gears, axles, paddles, clutches and chains located in the aft embodiment while flotation is provided by a single float member at the front of said craft.

U.S. Pat. No. 5,643,020 (Harris) titled Personal Water Craft. Harris disclosed a pedal craft accepting the user in a prone peddling position with a single pneumatic buoyant member providing flotation with two thrust units affixed to the aft portion of said craft. Operation of said thrust units depend on sufficient air pressure in a single buoyant member.

U.S. Pat. No. 7,097,521 (Papadakis) titled Self Propelled Surfboard, relates to pedal propelled embodiment accepting the user in a prone position while pedaling a crank that is claimed to rotate a connected propeller.

French Patent No 7,346,435 disclosing an apparatus accepting the user in a prone configuration with the operator pedaling a crank rotably connected to a plurality of gears on the starboard side that in turn rotates a propeller rotably mounted at the aft portion of said craft. User's planar support is on the same vector as the pedal axle at apex.

U.S. Pat. No. 1,071,113 (Teters) called Swimming Appliance. Teters claims a craft propelled by the user laying prone on said device while pedaling a crank that turns rotably mounted beveled gears rotating an operatively mounted propeller creating thrust.

SUMMARY OF THE INVENTION

It is the object of the present invention to provide a personal water craft that overcomes the deficiencies of prior art with many novel features as follows:

Snorkeling is a popular aquatic sport in warm climates throughout the world. The present invention being a pedal powered personal water craft of unique design lending to persons who desire to snorkel observing undersea life in a comfortable prone position of appropriate pedal posture while enjoying the ease of navigating by pedal propulsions with least expenditure of effort than swimming with or without swim fins.

Said craft provides for two or more to be attached side by side offering companionship cruising and can easily be operated by non-swimmers.

Further, said crafts keel extends downward below the user providing protection for the user in shallow water. Further said craft has the means to brake and reverse direction by reversing pedal from a forward direction.

Further, said craft floats in a planar fashion level at the water surface with or without a passenger. Flotation is achieved by a plastic enclosed foam planar center section with a padded non skid surface to accommodate the user's torso. Additional buoyancy is provided by pneumatic flotation tubes attaching to longitudinal planar spars on the starboard and port side of said craft. Said spars are affixed in parallel to each side of said center section accommodating more than one pneumatic member on each spar creating a safe stable seaworthy navigable craft of balanced flotation. Polyfoam buoyant members may be attached to said spars in lieu of pneumatic flotation.

Further, a stabilizing fin is removably attached to the bottom of said center section and keel member which tends to maintain a desired course of said craft when underway. Steering is accomplished with a rudder aft of said propeller actuated by a push pull rod convenient to the users hand.

Further, said craft is constructed of strong corrosion resistant materials as aircraft grade aluminum, nylon or similar plastic and stainless steel.

Further, said propulsion unit utilizes an adjustable pedal crank with length adjustable arms.

Further, users feet are assured a sung fit as pedal foot enclosures are adjustable to various sizes while held in the desired position by hook and loop system.

Further, said propulsion unit utilizes a pedal crank turning two operatively connected bevel gears that rotate a propeller shaft turning within plastic bearings rotating a pitch adjustable propeller creating thrust. Various gear ratios may be achieved as said propulsion unit accepts a choice of bevel glass. Users are protected from rotating parts of said propulsion unit by a removable shroud encompassing said unit.

Further, said propulsion unit is removably attached to said floating embodiment having the means to be used by a person using a breathing apparatus such as Scuba. Said propulsion units may be attached to the user's chest by a connecting member or to the user's scuba tank achieving pedal propulsion while diving or swimming.

Further, said craft is comprised of a novel combination of independent members of unity that may be easily replaced in event of damage.

Further, little time is required for assembling of said craft into a portable configuration that may be transported in the trunk of an automobile or on a bicycle. Said craft is of lightweight construction weighing less than twenty eight pounds as so described.

Further, said craft has the selective ability to easily be adjusted to various sizes of users, as a telescoping connection between said keel and said propulsion unit allows said propulsion unit to slide fore and aft with the desired position being secured by a quick release pin.

Yet another object of said craft is to provide protection from the sun for the user. Shade is accomplished by a canopy of Dacron or similar material affixed between two bowing rods spanning fore to aft removably connected on the ends of said spars not shown.

Further, it is the object of said craft to provide a planar cargo surface of the purpose of supporting such items as a life saving equipment, ice chest or spear guns. Said surface is removably attached at the aft end of said spars above the water surface. Items are secured to said surface by hook and loop binding straps.

Further, said craft may have a transparent plastic half dome removably attached between the fore portion of said spars with some portion below the water surface and some portion above the water surface affording the user to view undersea life without mask or snorkel.

Further, said craft may have the means for a flag pole to be removably attached for the purpose of being seen by other watercraft. A diver's flag may be used or any flag that will attract attention. Said flagpole may be approximately one quarter inch diameter extending above the surface to a sufficient height to be visible by other water craft in close proximity.

Further, said craft may have a round shroud encompassing said propeller for the purpose of providing a more efficient thrust while also providing protection for said propeller.

Further, navigation of said craft is little affected by wind due to the low profile of said craft.

Further, said craft can be useful not only as a recreational vehicle but also as a life saving device affording a stable planar buoyant surface capable of carrying an unconscious person while being pedal-navigated to safety by a lifeguard.

Further, the present craft is of metamorphic design having the discrete means to become a submersive embodiment offering the user an option to submerge viewing undersea life while using an underwater breathing device such as a rebreather or scuba equipment. Said submersible is the same craft as previously described equipped with four pneumatic float, tubes and a system to inflate and deflate said pneumatic floats.

Further, said craft may be a useful vehicle for Navy Seals between boat and beach equipped with a bullet resistant shield attached to the fore portion of said spars. Said submersible version could also prove beneficial in Seal operations.

Further said craft may be utilized as an exercise device in a small body of water such as a small swimming pool.

COMPONENT REFERENCES

Figure 1:
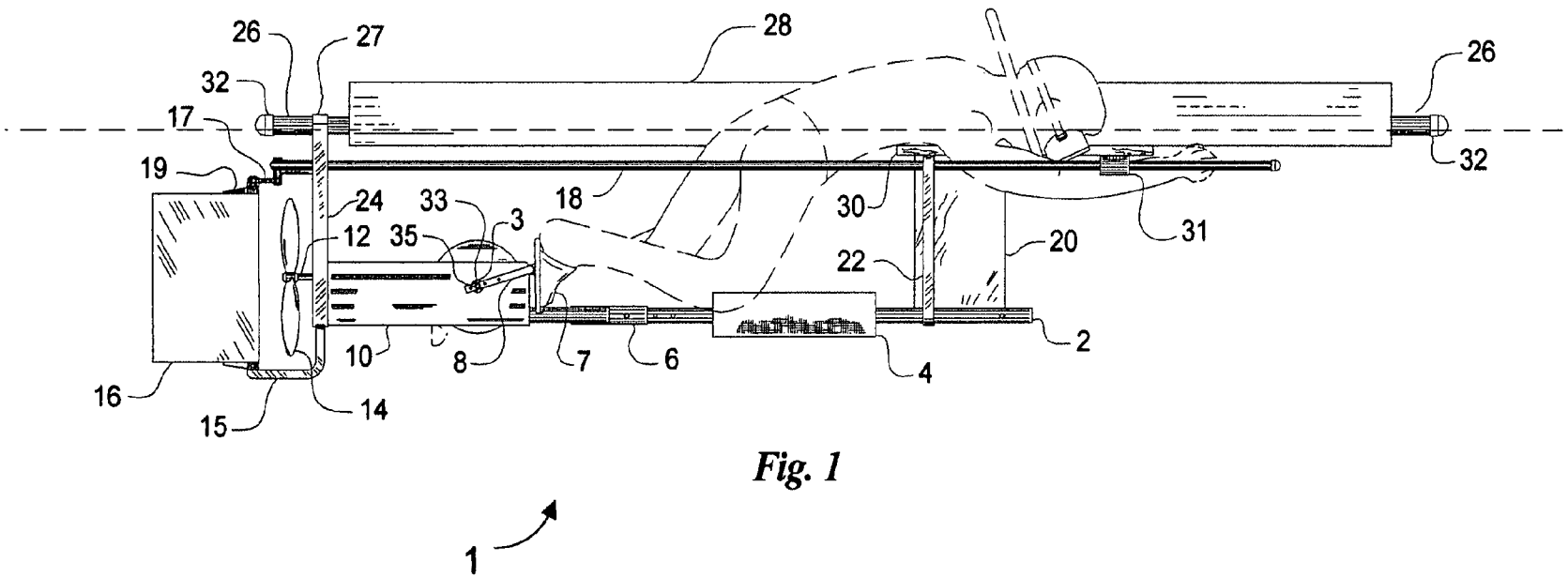
FIG. 1. View of starboard side of the preferred embodiment equipped with polystyrene float members showing position of operator.

1. Personal watercraft floating embodiment
2. Keel
3. Propulsion unit pedal crank axle
4. Polystyrene sit pad
5. Propulsion unit axle bearing
6. Propulsion unit connection to keel
7. Adjustable foot enclosure
8. Adjustable pedal crank arm
9. Propeller shaft bearing
10. Propulsion unit shroud
11. Propulsion unit frame
12. Propeller Shaft
13. Propulsion Unit
14. Propeller
15. Lower rudder attached member
16. Steering rudder
17. Rudder actuating member
18. Steering rod
19. Top rudder attachment member
20. Stabilizer fin
21. Drive Bevel gear
22. Fore Vee strut
23. Aft cross brace
24. Aft Vee strut
25. Pinion gear
26. Spars
27. Slide connection
28. Polystyrene float member
29. Pneumatic float member
30. Center Section
31. Steer rod slide bearing
32. End caps
33. Pedal arm secure bolt
34. Inflatable members
35. Washer
36. Pneumatic regulator
38. Three functional pneumatic valve
40. Low pressure pneumatic manifold
42. High pressure pneumatic line
44. High pressure air supply tanks
46. Propulsion unit diver attachment
48. Diver chest attachment member

DETAILED DESCRIPTION OF THE PRESENT INVENTION

With reference to FIG. 1 the preferred embodiment is depicted with the user's body supported by a center section while pedaling said propulsion, unit 10, creating thrust. Said embodiment (1) is shown floated by polystyrene buoyant members (28) that are attached to said craft by internal spars (26) that are sufficiently affixed to a center section (30) and aft vee strut (24). A keel (2) is affixed to the bottom of forward vee strut (22) and the stabilizer fin (20) while aft portion of said keel is attached to said propulsion unit (10) in a telescoping manner affording length adjustment for various sizes of users being secured in a desired position by a quick release pin (6). Aft end of said propulsion unit is secured to aft vee strut (24) while said vee strut (24) is attached to the aft portion of each said spar (26) by a slide connection (27) moving fore and aft to the selected position. A sit pad of polystyrene (4) is provided for user when setting upright on said keel (2).

Steerage is accomplished by the user pushing or pulling on steering rod (18). Said rod is secured at the front within a slide bearing (31) convenient to user and at the rear by the rudder actuating arm (17). As a user pushes said steering rod (18) forward the actuating arm (17) moves the pivotally attached rudder to port. When said rod (18) is pulled aft said rudder will be moved starboard.

The nucleus of the embodiment is the center section (30) float member being of light weight ridged foam encased in a protective plastic skin.

Said center section (30) adds rigidity and flotation for said embodiment.

Said spar ends (26) are covered by plastic bumper caps (32) at their ends for protection of spar ends and users.

Figure 2:
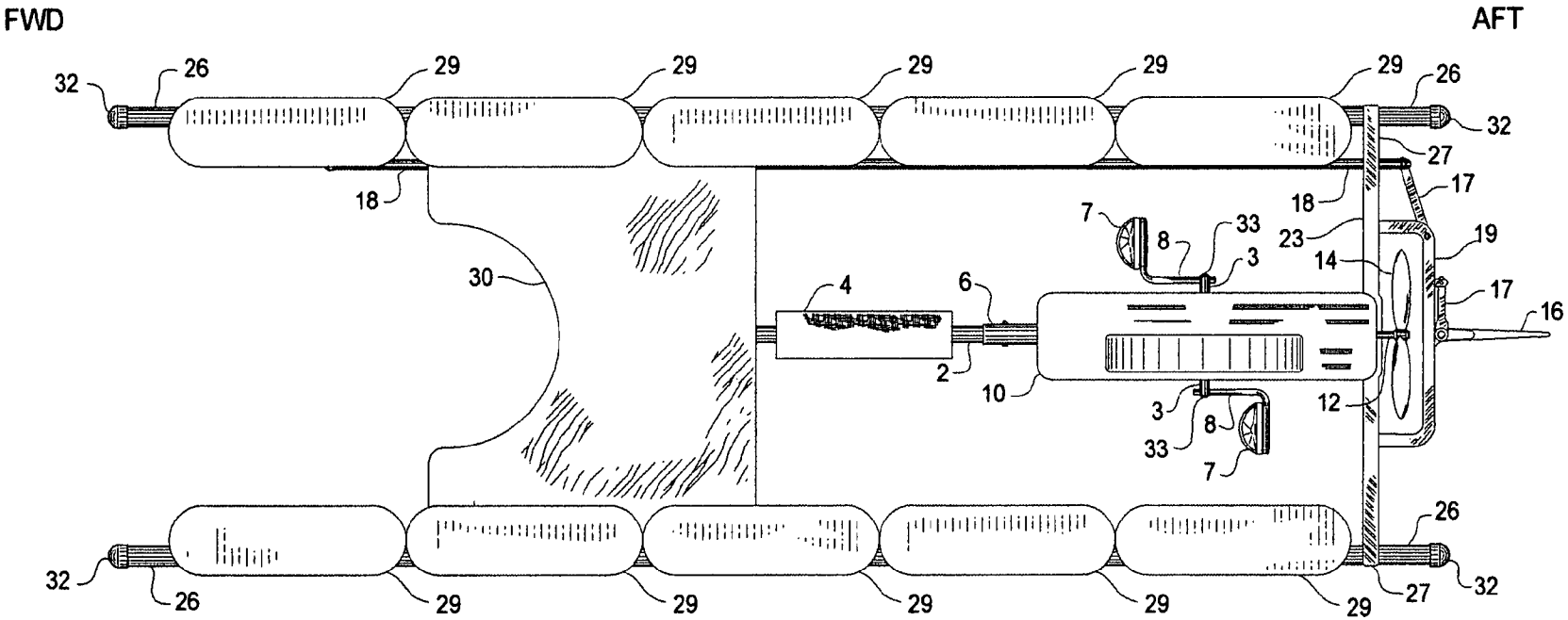
FIG. 2. Top View of the preferred embodiment equipped with multiple pneumatic float members FIG. 3. Starboard view of FIG. 2 with thrust unit shroud removed FIG. 4. Top view of the second preferred embodiment FIG. 5. Bottom view of the second preferred embodiment FIG. 6. Side view of the third preferred embodiment showing position of the operator.

Shown in FIG. 2 is the same embodiment as FIG. 1 with the exception of said float members.

The craft in FIG. 2 is equipped with multiple inflatable float members (29), said floats are convenient to be inflated as user can easily inflate, similar as one would inflate a party balloon, a multiple float system is also a safety feature in the case of damage to said float member by sharp rocks, debris or shark bite, a craft with multiple float members is more likely to remain operational than a craft with one or two inflatable float members, while polystyrene floats (28) are durable, inflatables (29) offer a more condensed portability and lighter craft.

Figure 3:
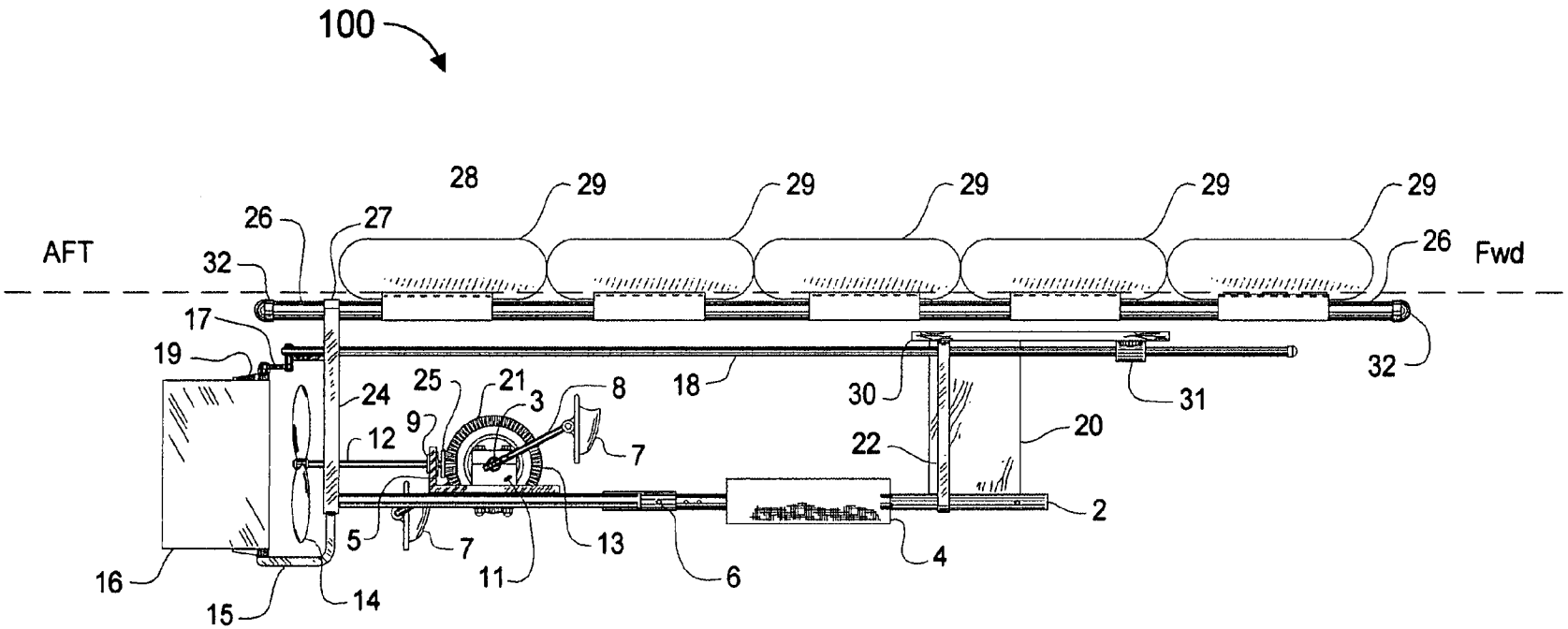

Said propulsion Unit FIG. 3 (13) has a removable affixed shroud FIG. 2 (10) enclosing said bevel gear for the protection of users and to keep debris out of said gear mechanism.

With reference to FIG. 3 showing said propulsion unit with said shroud removed. As a user pedals said pedal crank (8) the rotably attached larger bevel gear (21) is rotated within plastic water lubricated bearings (5) meshing with a smaller pinion gear (25) affixed to the forward end of said propeller shaft (12) rotating said propeller five times for every one rotation of said axle (3) creating thrust. Said propeller shaft rotates within plastic non corrosive water lubricated bearing (9).

Figure 4:
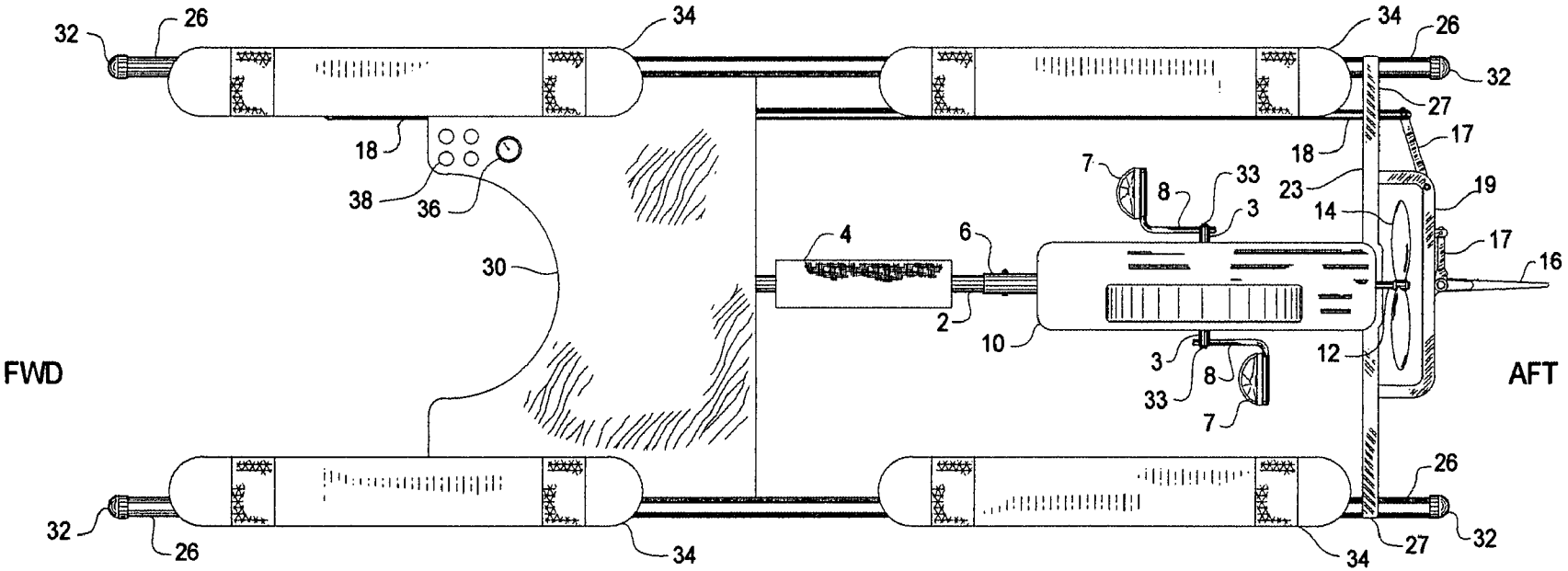
Figure 5:
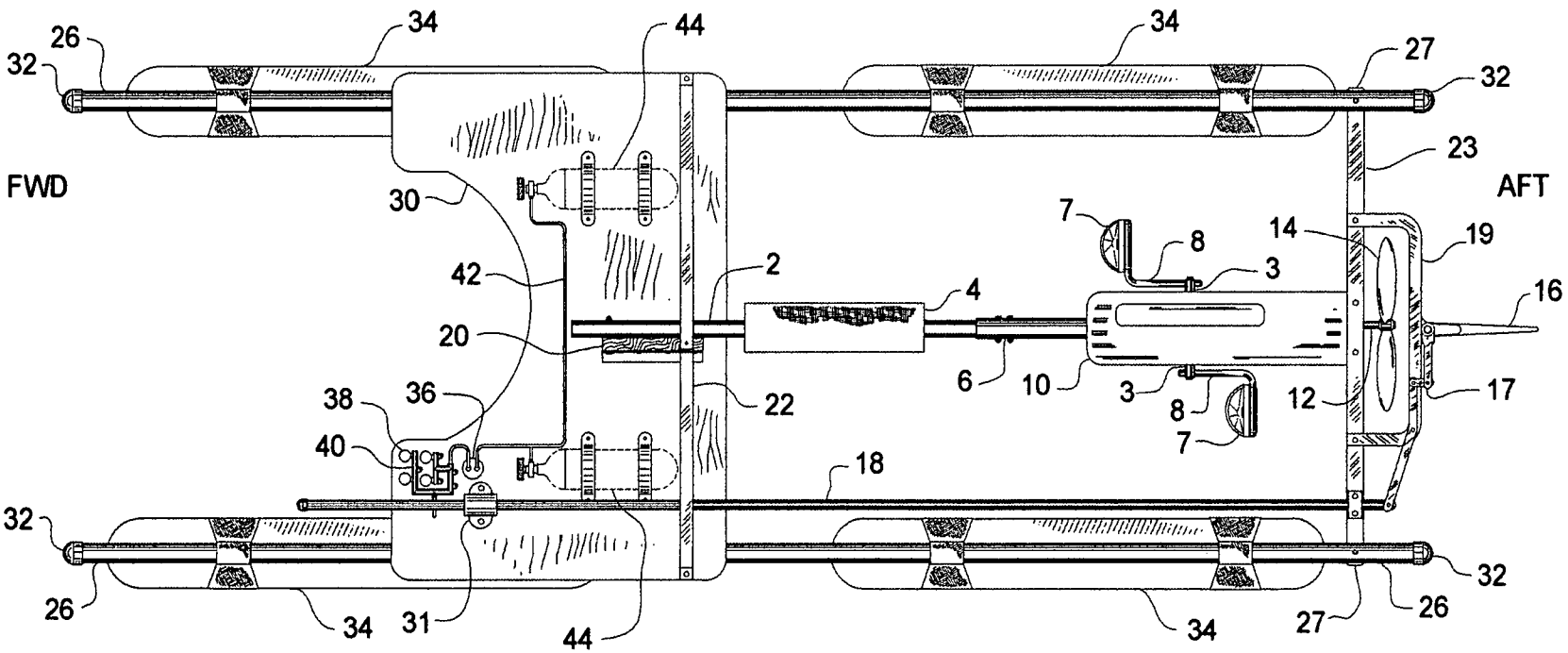

With reference to FIGS. 4 and 5 being the second preferred embodiment with the means to submerge and surface as the user desires by inflating and deflating pneumatic float members (34) sufficiently attached on said spars at the fore and aft portion of port and starboard spars. A pneumatic line (42) connects said four float members (34) to the pneumatic manifold (40) equipped with four three way functional valves (38) with selections of CLOSE-FILL-EVACUATE said valves are appropriately placed for user convenience within said center section (30). Said manifold (40) is pressured by means of two high pressure air tanks (44) attached to the bottom side of said center section (30). A pneumatic high pressure line (42) from said air tanks (44) provides pressure to a pneumatic regulator (36) that provides a desired air pressure to said manifold (40) providing means for a user to selectively inflate or deflate any one of said buoyant members (34) affording the user selective descent or ascent and pitch. Control while being thrusted by said pedal propulsion on or below the water surface.

Figure 6:
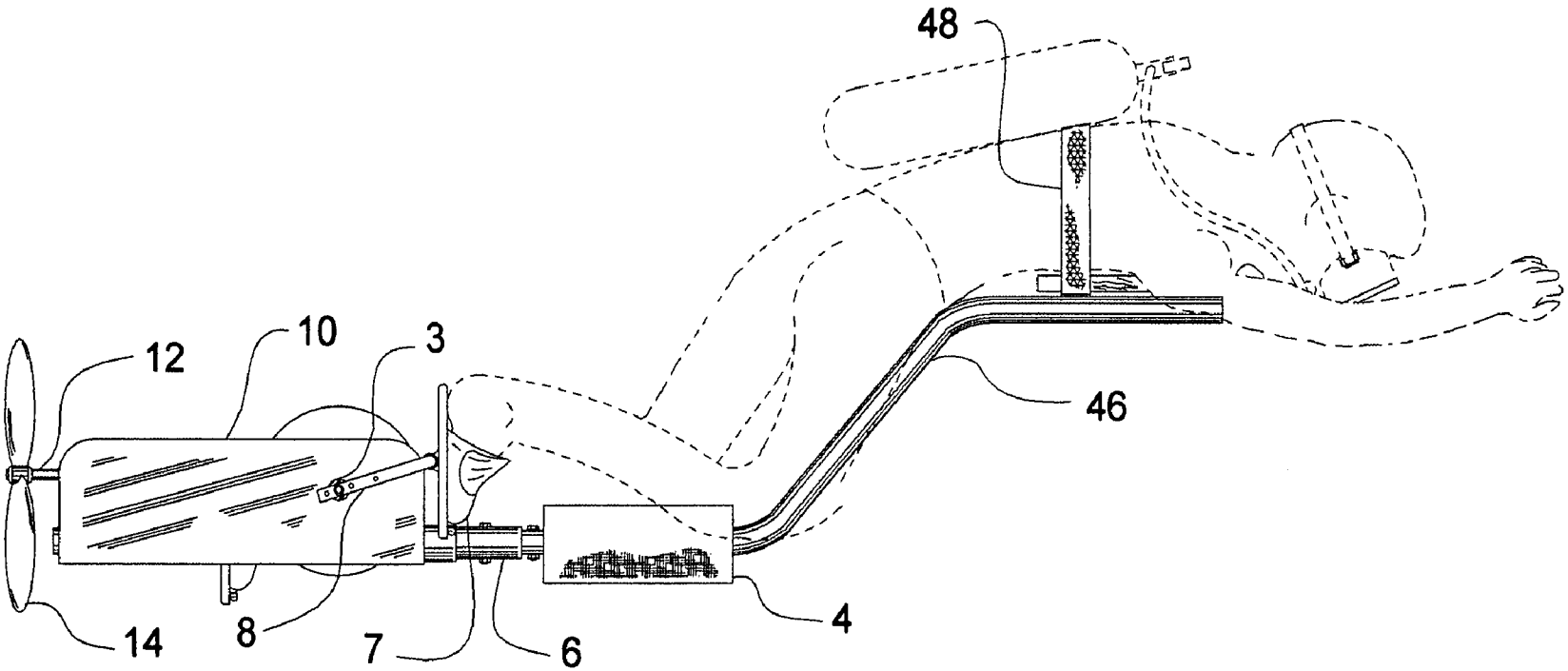

With reference to FIG. 6, a third preferred embodiment offering the user pedal thrust propulsion without a floating embodiment. Said propulsion unit FIG. 3 (13) being detached from said floating embodiment (1) now attaches to member (46) in a telescoping fashion and secured with a quick release pin (6). Member (46) is secured to user's chest by means of an encompassing strap (48) or to a users SCUBA tank by an appropriate attachment offering the user thrust with the least expenditure of effort.

Figure 7:
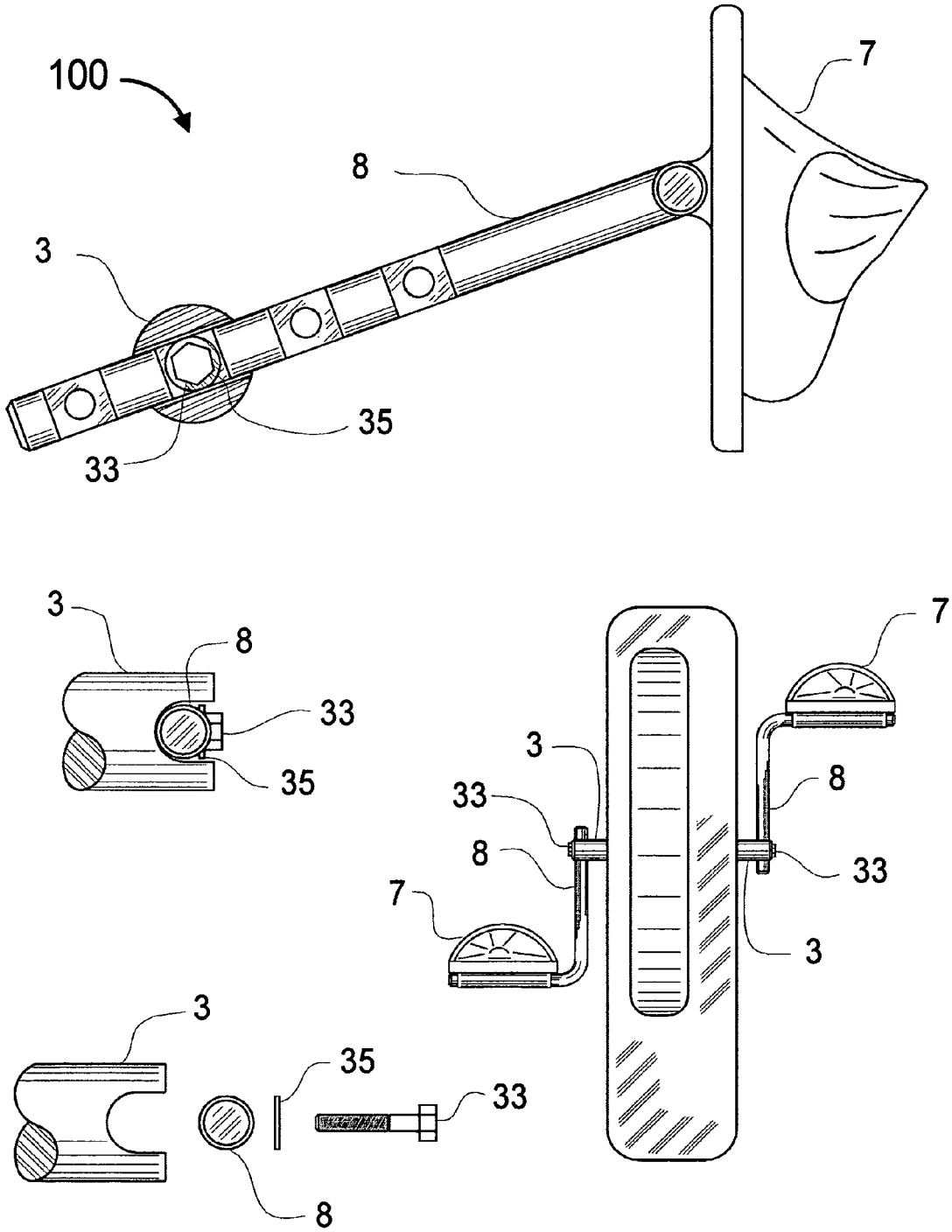
FIG. 7. Adjustable pedal crank arm.

With reference to FIG. 7 illustrating adjustment of pedal crank arm (8). Said crank arm (8) may be adjusted to various lengths by attaching said arm (8) to said axle (3) by means of a bolt (33) with washer (35). Length adjustment of said arm (8) affords the user various positions of pedal leverage when peddling said craft.

As the adaptation of my invention will vary, I desire to emphasize that various minor changes in details of construction, proportions and arrangement of members may be applied within the scope of the appended claims without departing from or sacrificing any of the principles of the invention.

Having described my invention what I desire to be protected by letters of patent is as set forth in the following claims.

The invention claimed is:

1. A personal planar aquatic craft of pedal propulsion consisting of impendent members of unity selectively positioned to form a functional buoyant craft of level floatation excepting the user's torso laying in a prone position on the apex of said craft being a buoyant center section having width and length sufficient to support a users torso, longitudinal flotation spars of strength being attached on port and starboard sides of said center section extending forward of users head and aft of users feet, a vertical stabilizer fin member is sufficiently attached to the bottom of said center section extending downward attaching to a longitudinal keel member extending fore to aft with aft portion providing a telescoping adjustable attach point for said propulsion unit of appropriate mechanical function rotating a propeller, creating thrust as an operators feet rotate a pedal crank, steerage of said craft is provided by a pivotably attached rudder aft of said propeller of appropriate linkage to be controlled by an operator.

2. The craft of claim 1 further comprising a removably attached propulsion unit containing no more than seven moving parts, being starboard and port side rotating pedals, a pedal crank axle, an attached drive bevel gear, a pinion gear shaft, a thrust bearing and a pitch, adjustable propeller with rotating members turning within water lubricated plastic bearings.

3. The craft in claim 1 with said propulsion pedal crank arms having the means for length adjustment and foot enclosures adjustable for various sizes of feet by means of hood and loop fastening.

4. The craft in claim 1 with said center section having a front leading edge recessed, providing means for a user to lower their head into the water to observe undersea life.

5. The craft in claim 1 with said propulsion unit having an encompassing shroud covering said gears with means to be timely removed and attached.

6. The craft in claim 1 with a shroud encasing said propeller.

7. The craft in claim 1 with three or more support float members being of inflatable or of plastic close cell foam or both.

8. The craft in claim 1 further comprising a propulsion unit creating a thrust vector parallel with the waters surface when in operation.

9. The craft in claim 1 further comprising a propulsion member with the propeller being at a sufficient depth to eliminate cavitations in unlevel waters.

10. The Craft in claim 1 further comprising a pedal propulsion member axle selectively positioned below the vector of the user's spine to offer an appropriate pedal posture while peddling said craft.

11. The craft in claim 1 providing the selective means for one or more components to be readily replaced in the event of damage.

12. The craft in claim 1 providing means for an operator to sit upright on a padded keel.

13. The craft in claim 1 with means for a flag to be attached at sufficient height to be readily observed by other craft with said flag being four to five feet above the surface.

14. The craft in claim 1 with means for forward and reverse thrust.

15. The craft in claim 1 having the means for a user to sit on a planar surface with extremities out of the water.

16. The craft in claim 1 comprising a planar cargo shelf removably attached to the aft portion of said spars with said shelf being above the water surface.

17. The craft in claim 1 having a transparent half dome removably attached between the fore portion of said spars with some portion above the water surface and some portion below the water surface affording the user to view under sea life while operating said craft.

18. The craft in claim 1 further comprising said propulsion unit with said drive bevel gear backed with a thrust bearing at point of pressure on opposite side of gear teeth at a point where said drive gear meshes with said pinion gear.

19. The craft in claim 1 having a protective longitudinal keel providing an adjustable attach point for said propulsion unit.

20. The craft in claim 1 further comprising a storage tank of compressed air, a pneumatic line, a pneumatic regulator, a pneumatic manifold with four three function valves, four pneumatic flat members having the function to be inflated and deflated by an operator offering the user the means to submerge and surface as desired.

21. The craft in claim 1 further comprising two bowing members extending from the fore end to the aft end of said spars above said craft having a material attached between said bows providing protection from the sun for a user.

22. The craft in claim 1 with means for two or more of said craft to be connected side by side.

23. A personal aquatic snorkel craft consisting of independent members of unity selectively positioned to form a functional buoyant craft of pedal propulsion composed of a buoyant center section excepting the users torso in a prone position, two longitudinal inflatable float spars attached to port and starboard side of said center section, with said float spars extending fore beyond the users head and aft of the users feet, a stabilizer fin attached to the bottom side of said center section with said stabilizer fin attached to a keel member, a pedal propulsion unit, a steerable rudder with a portion of said center section leading edge being recessed to accommodate a user to easily lower their face into the water while peddling said propulsion member.

24. The craft in claim 23 comprising a personal aquatic snorkel craft consisting of independent members of unity selectively positioned to form a functional buoyant craft of pedal propulsion excepting a user's torso in a prone position of appropriate pedal posture with the rotating axles of said propulsion unit being sufficiently below the vector of the user's back.

* * * * *